United States Patent [19]

Taylor

[11] 4,415,051

[45] Nov. 15, 1983

[54] MULTIPLE PERSONNEL TRANSPORTER VEHICLE FOR LOW VEIN MINES

[75] Inventor: Jerry F. Taylor, Mt. Vernon, Ill.

[73] Assignee: Mine Equipment Company, Mt. Vernon, Ill.

[21] Appl. No.: 261,922

[22] Filed: May 8, 1981

[51] Int. Cl.[3] ..... B62D 23/00; B60K 1/00

[52] U.S. Cl. ..... 180/65 R; 105/344; 105/364; 180/60; 296/64; 296/178

[58] Field of Search ..... 180/89.1, 317, 65 R, 180/65 E, 60, 244, 248, 249, 250, 57, 70 R; 296/178, 179, 64, 63; 105/344, 364

[56] References Cited

U.S. PATENT DOCUMENTS

| | | | |
|---|---|---|---|
| 1,219,529 | 3/1917 | Batenburg | 180/244 X |
| 2,014,071 | 9/1935 | Loveless | 180/57 |
| 2,490,162 | 12/1949 | Ruelle | 180/89.1 X |
| 2,501,503 | 3/1950 | Flowers | 105/344 |
| 2,588,341 | 3/1952 | Beck | 180/65 E X |
| 2,812,191 | 11/1957 | Kersey, Jr. et al. | 180/65 R X |
| 2,936,035 | 5/1960 | Hill | 180/244 |

FOREIGN PATENT DOCUMENTS

| | | | |
|---|---|---|---|
| 826549 | 1/1952 | Fed. Rep. of Germany | 296/178 |

*Primary Examiner*—Joseph F. Peters, Jr.

*Attorney, Agent, or Firm*—Schmidt, Johnson, Hovey & Williams

[57] ABSTRACT

An improved, low height, electrically powered mine car is provided for transporting an entire crew (up to eleven persons) in a low vein mine shaft which includes strategically located and sized personnel and driver compartments for maximum load capacity. The main crew compartment is oriented to hold up to eight individuals who lie in a substantially supine position with their limbs intertwined; the forward end of the car has a central driver compartment allowing the operator to steer and control the car in a generally supine position, as well as two additional personnel compartments respectively ahead of the front wheels where the passengers may ride in a reclined position. The motor, main differential and drive shafts are substantially encased within a housing structure in order to prevent fouling of these components by dirt or the like encountered in a mine shaft. Spring structure for the car combines low profile, rugged characteristics and minimum space requirements. In addition, a pair of disc brake assemblies are respectively coupled to the two output shafts of the main differential for braking purposes, and these assemblies are likewise encased within the housing structure.

8 Claims, 9 Drawing Figures

MULTIPLE PERSONNEL TRANSPORTER VEHICLE FOR LOW VEIN MINES

BACKGROUND OF THE INVENTION

1. Field of the Invention

The present invention is concerned with a specially designed, low height mine car which is adapted to carry a large number of individuals at one time in low vein mine shafts and all lying on their backs in substantially supine positions. More particularly, it is concerned with a mine car that is constructed with a number of strategically arranged personnel compartments making maximum use of the space available in the car, and wherein the mechanical drive and braking components are encased within housing structure in a manner to prevent fouling thereof under the rather severe conditions of use encountered in a mine shaft.

2. Description of the Prior Art

Many coal mines and the like are of the so-called low vein variety wherein ore veins are of limited height, often as low as 30 inches or less. As can be appreciated, such height conditions present a number of specialized problems in terms of the ability of personnel to move about in the mine or be transported to and from the mine face. This is particularly troublesome when an entire crew must be moved to a working site in a shaft over relatively long distances. In fact, a considerable portion of a normal work day can be consumed in moving in and out of a mine shaft.

The problems of mobility are further compounded by virtue of the fact that mine floors are quite often wet and muddy, and extremely uneven. This has proven troublesome in the past, inasmuch as the drive, suspension and braking components of prior mine cars have been known to become fouled, requiring cleanup or repair. This is extremely difficult in the restricted height conditions of a low vein mine shaft.

Accordingly, there is a real need in the art for an improved mine car usable in the context of low vein mine shafts which is rugged and not susceptible to frequent breakdowns, and further which is capable of transporting a large number of individuals (desirably an entire crew).

SUMMARY OF THE INVENTION

The above problems are solved by the present invention which provides a greatly improved low height mine car which can carry up to eleven persons and is specially designed to withstand rugged use attendant to operation in low vein mine shafts.

Broadly speaking, the mine car of the present invention includes an elongated, personnel carrying body supported by spaced fore and aft wheels and provided with electric power means drivingly coupled to the wheels for propelling the car. A minimum height of the body supported on the wheels can be as low as 26 inches.

The main body of the car includes structure defining a first personnel compartment for accommodating at least two persons (preferably eight) and has a bottom wall and a pair of upstanding, opposed end walls spaced horizontally a distance greater than the length of an average man's legs, but less than an average man's height. The arrangement is such that a plurality of individuals can lie in a generally supine position within the compartment with their legs intertwined. A pair of access openings between the end walls of the compartment are provided for entry and exit of the compartment by the crew members.

A forward driver compartment is provided separate from the personnel compartment, whereas second and third personnel compartments are respectively disposed on opposite sides of the driver compartment. The persons occupying these spaces also repose in supine positions, including the driver, who retains full control over the vehicle steering and operating mechanisms.

Electric battery means in the form of a pair of electric storage batteries are located at the extreme rear of the car, and are employed to power an electric motor and differential assembly. The latter is connected by means of respective fore and aft drive shafts to the wheels of the car.

Another feature of the invention includes the use of structure for substantially enclosing the electric motor, differential, and a majority of the drive shafts within a housing in order to prevent dirt or the like from fouling these vital drive components.

Finally, a pair of disc brake assemblies (one for each of the front and read wheel sets) are respectively coupled to the two outputs of the main differential. These brake assemblies are likewise fully encased so that fouling problems are eliminated.

DESCRIPTION OF THE PREFERRED EMBODIMENT

Figures 1, 2, 3, 4:
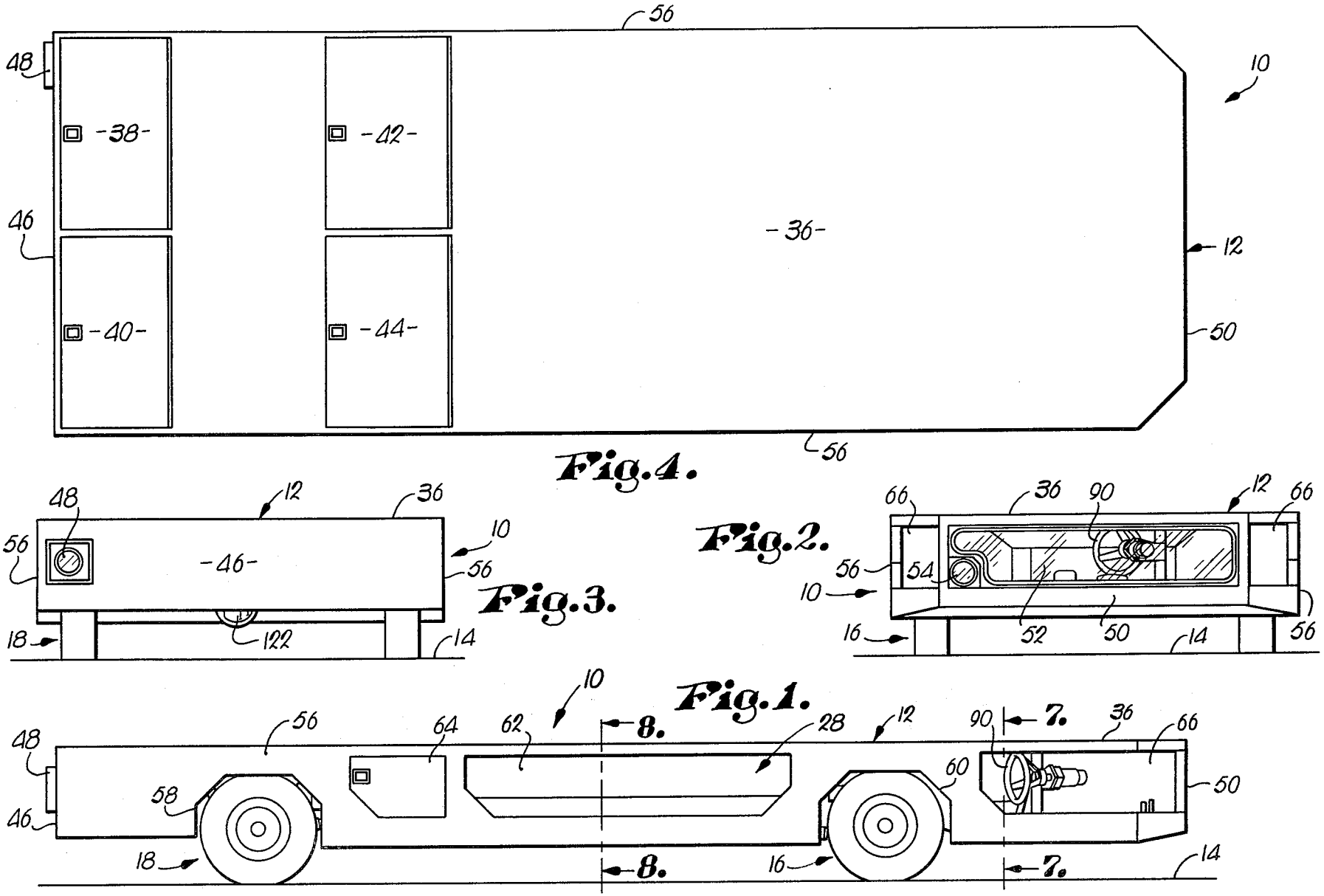
FIG. 1 is a side elevational view of a mine car in accordance with the invention.
FIG. 2 is a front elevational view of the car depicted in FIG. 1.
FIG. 3 is a rear elevational view of the car depicted in FIG. 1.
FIG. 4 is a plan view of the car depicted in FIG. 1.

Turning now to FIGS. 1-4, a mine car 10 in accordance with the invention broadly includes an elongated personnel-carrying body 12 supported on a mine surface floor 14 by means of front and rear wheel sets 16 and 18. The minimum height of car 10 can be as low as 26 inches, so that it can traverse even the very low vein mine shafts. Although most mine operators desire to use a car of minimum height to permit use thereof under even the most adverse conditions as represented by extremely low vein heights (in effect controlled only by accessible working height), the carrier of this invention can be made somewhat higher if desired by a particular mine operator, e.g., up to about 36 inches maximum effective operating height.

The car further includes rearmost electric storage batteries 20, 22, an electric motor 24, and a four wheel drive assembly broadly referred to by the numeral 26 which couples motor 24 to the wheel sets 16 and 18 for propelling the car 10. In addition, the car includes a main personnel compartment 28, a driver compartment 30, and forward personnel compartments 32, 34 respectively located on opposite sides of the driver compartment 30 and ahead of the front wheel set 16.

In more detail, the body 12 includes a metallic, substantially planar roof 36 having a total of four access doorways 38, 40, 42 and 44 therein. The respective access doorways are hingedly mounted and allow access to the batteries 20, 22 (through doors 38, 40) and to important components of the assembly 26 (via doors 42, 44).

The body 12 further includes a rear wall 46 depending from roof 36 and provided with a brake light 48. Similarly, a front wall 50 depends from the forward margin of roof 36 and has a transparent windshield 52 therein as well as a headlight 54.

The body 12 also has a pair of identical sidewalls 56 which depend from side margins of roof 36 and interconnect rear wall 46 and front wall 50. Each sidewall 56 includes a pair of spaced wheel well openings 58, 60 which respectively receive a wheel of each set 16, 18, as best seen in FIG. 1. In addition, each sidewall includes an elongated access opening 62 which permits entry and egress from the main personnel compartment 28, hingedly mounted doors 64 rearward of opening 62, and forward access openings 66 which permits entry and egress from the respective personnel compartments 32, 34, and from the driver compartment 30.

The body 12 is substantially enclosed by provision of a main bottom plate 68 extending between sidewalls 56 and substantially spanning the distance between the wheel sets 16, 18. In addition, a rear bottom plate 70 extends from rear wall 46 to a point adjacent the rear wheel set 18, and a forward bottom plate 72 is provided which extends from wheel set 16 to front wall 50 (see FIG. 6).

Figure 9:
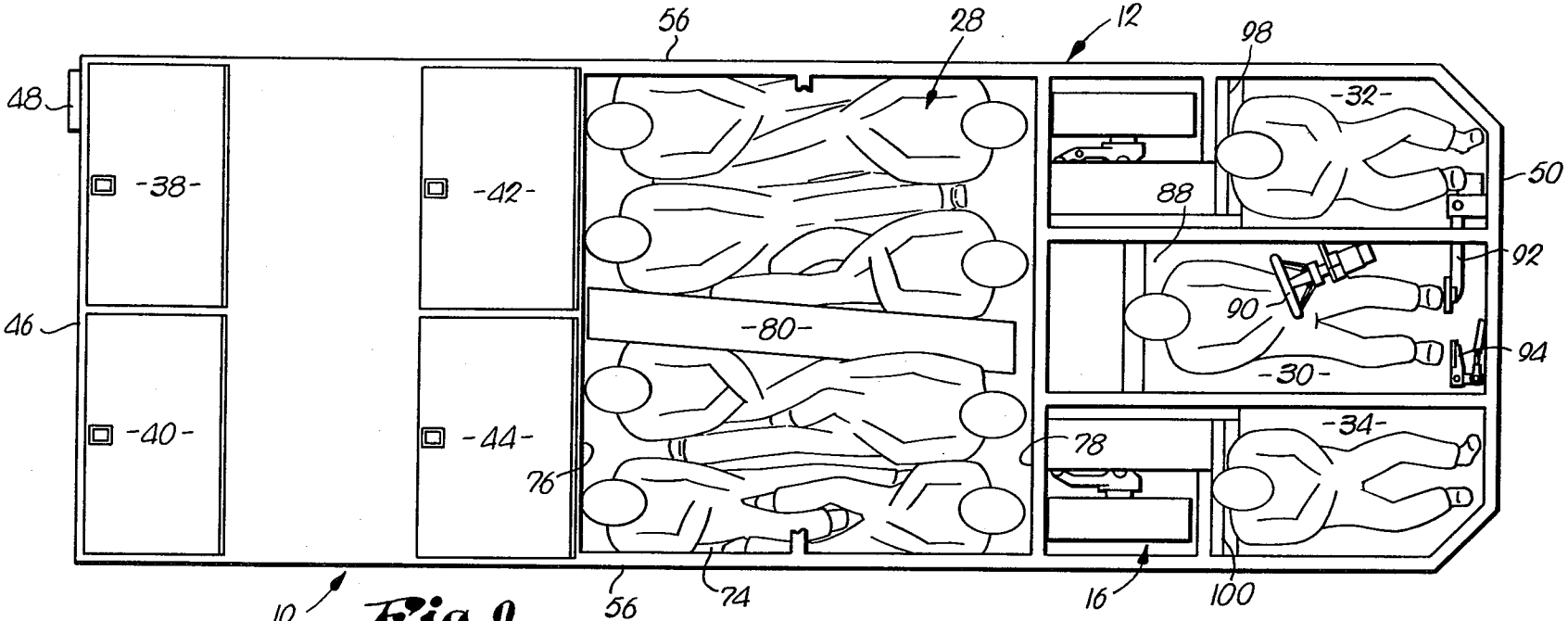
FIG. 9 is a top view of the car with a roof panel removed and showing a mine crew situated in the personnel compartments provided in the car.
Figure 7:
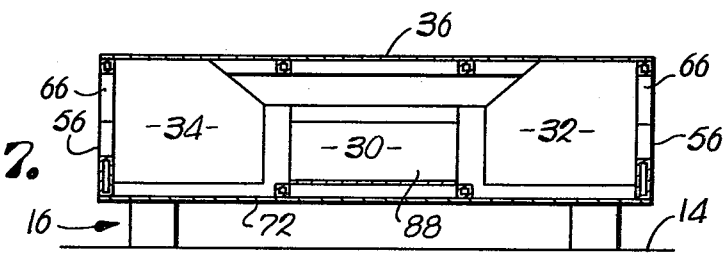
FIG. 7 is a sectional view taken along line 7—7 of FIG. 1.
Figure 8:
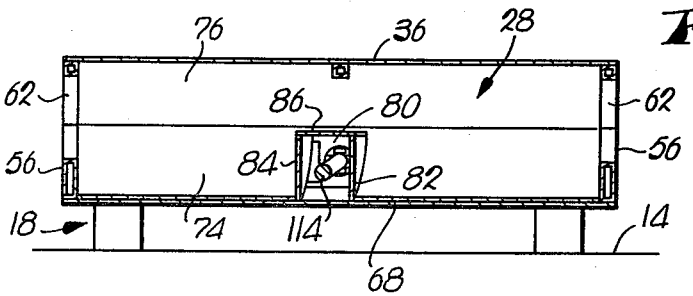
FIG. 8 is a sectional view taken along line 8—8 of FIG. 1.

The main personnel compartment 28 includes a somewhat arcuate in cross section bottom wall 74 with a pair of upstanding, spaced apart end walls 76, 78. A generally central, obliquely oriented tunnel 80 (see FIGS. 8 and 9) defined by upstanding walls 82, 84 and top wall 86 serves to effectively divide compartment 28 into a pair of side-by-side sub-compartments. The purpose of tunnel 80 will be made clear hereinafter. In any event, it will be observed (see FIG. 9) that the distance between the end walls 76, 78 is greater than the length of an average man's legs, and less than an average man's height, so that the individuals within compartment 28 can lie in a generally supine position and in generally opposed, fore and aft relationship to one another with their legs intertwined. As noted above, the access openings 62 permit entry and egress into compartment 28 by the mine crew.

The central driver compartment 30 is provided with an arcuate in cross section bottom wall 88 which extends between the wheels of forward set 16, and is connected to forward bottom plate 72. An obliquely oriented steering wheel 90 is located within compartment 30, along with a brake pedal 92, accelerator pedal 94, and an emergency brake operating handle 96.

The respective forward personnel compartments 32, 34 are defined by the underlying portions of plate 72, as well as an upstanding headrest support 98, 100. It will be observed in this respect that the openings 32, 34 are in communication with central driver compartment 30, so that the driver can have access to his compartment through either of the openings 66, and can further see out of such openings during operation of car 10.

Figure 5:
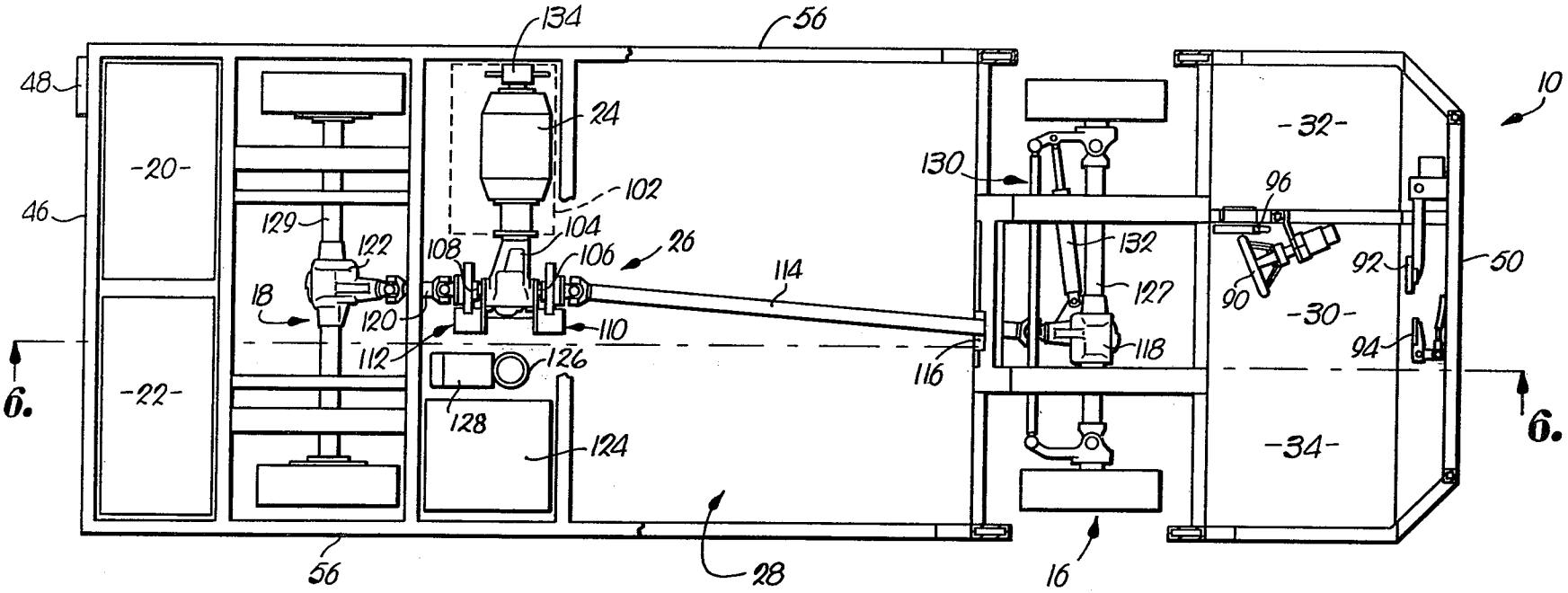
FIG. 5 is a bottom view of the mine car, with parts broken away for clarity, and certain parts shown in phantom.
Figure 6:
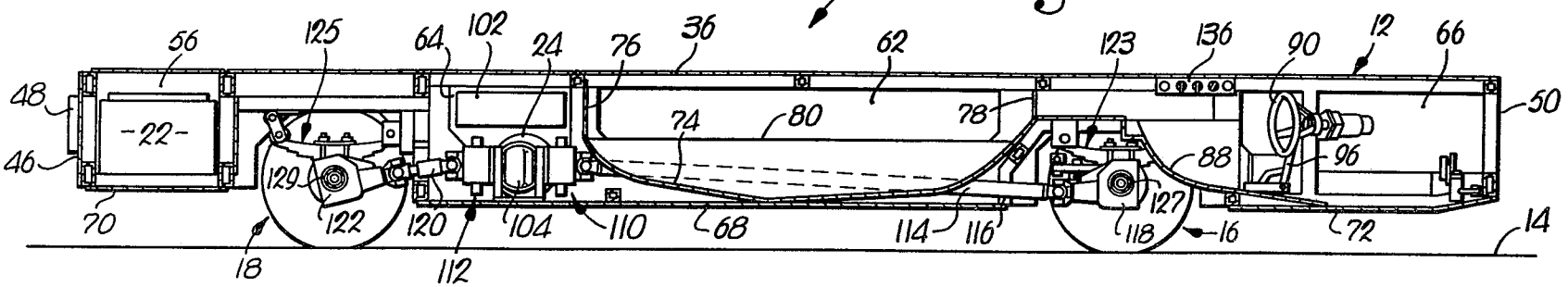
FIG. 6 is a vertical sectional view taken along line 6—6 of FIG. 5.

The drive assembly 26 includes, in addition to motor 24, a conventional controller 102 operatively coupled between the motor 24 and the batteries 20, 22. As best seen in FIGS. 5 and 6, controller 102 is located above motor 24 and beneath access door 42.

A main differential 104 is coupled to the output of motor 24 and in turn has forward and rearward output shafts 106, 108 which respectively extend fore and aft as best seen in FIG. 5. A pair of disc brake assemblies 110, 112 of the usual construction are respectively mounted on output shafts 106, 108 in order that, when actuated, the assemblies provide a braking action for car 10 by slowing and stopping the rotation of the output shafts.

A forwardly extending drive shaft 114 is operatively coupled to the outermost end of shaft 106, and extends through tunnel 80 and out a forward opening 116 (see FIG. 5). The forward end of shaft 114 is coupled to a front differential 118, which is in turn drivingly connected to the wheels of front wheel set 16.

In a similar fashion, a rearwardly extending drive shaft 120 is coupled between the outermost end of shaft 108 and a rear differential 122, the latter being drivingly coupled to the wheels of set 18. Of particular note is the provision of two pairs of short coupled leaf spring assemblies 123 and 125 supporting the chassis and body unit on respective wheel axles 127 and 129. The leaf spring assemblies 123 and 125 are mounted on top of corresponding axles through the medium of opposed U-bolts. By virtue of top mounting of the springs, there is no tendency for the U-bolts to become elongated during repetitive travel of the vehicle carrier over the extremely rough floor terrain of mine shafts thus eliminating attendant problems previously encountered with broken springs and even broken axles traceable to U-bolt elongation, shearing of the bolts holding the leaves of the springs together and excessive wear on the entire suspension components. Furthermore, the use of close coupled springs not only permits mounting thereof on the top of corresponding axles without increasing the road height of the vehicle, but also significantly improves the ruggedness of the suspension even under the adverse conditions encountered in mines.

The assembly 26 further includes a battery charger 124 located beneath access door 44. The charger 124 is operatively coupled to the batteries 20, 22 in order to charge the same from available electrical supplies in a mine. In addition, hydraulic fluid reservoir 126 and hydraulic pump 128 are located adjacent charger 124 beneath door 44 for ease of access thereto.

Steering for car 10 is provided by an assembly 130 operatively coupled to front wheel set 16. The steering is hydraulically operated by means of a hydraulic piston and cylinder unit 132 which is operatively coupled between steering wheel 90, reservoir 126 and pump 128. Inasmuch as the component parts of assembly 130 are essentially conventional, a detailed description of the construction and operation thereof is deemed unnecessary.

As explained above, the main differential 104, disc brake assemblies 110, 112, and a majority of the lengths of the drive shafts 114, 120 are enclosed within casing structure preventing fouling thereof by dirt or the like encountered in a mine shaft. Such casing structure includes main bottom plate 68, tunnel-defining walls 82, 84 and 86, sidewalls 56, and top wall 36. In any event, it will be appreciated that these vital components are protected against fouling or the like which has presented considerable problems with prior mine cars.

The braking assembly for car 10 further includes an emergency brake 134 operatively coupled to motor 24 and connected to handle 96 by conventional cable means. Further with respect to the driver compartment 30, it will be appreciated that accelerator pedal 94 is connected to the motor controller 102, whereas the disc brake assemblies 110, 112 are connected to pedal 92 and to the hydraulic system for the car. Finally, electrical control switches 136 (see FIG. 6) are mounted adjacent top wall 36 within the driver compartment 30 for control of the assembly 26.

I claim:

1. A mine car, comprising:

an elongated, personnel-carrying body;

surface-engaging means supporting said body; and electric power means drivingly coupled to said surface-engaging means for propelling said car, the maximum height of said body supported on said surface-engaging means being as low as about 26 inches, said body including structure defining a first personnel compartment for accommodating at least two persons in a generally horizontal position, said structure comprising a bottom wall, a pair of upstanding, opposed end walls spaced apart a distance greater than the length of an average man's legs and less than an average man's height, and means defining an access opening between said end walls permitting entry into said compartment by said persons;

means defining a compartment forwardly of and separate from said personnel compartment and configured for accommodating a driver in a substantially horizontal position;

means defining second and third personnel compartments respectively disposed on opposite sides of said driver compartment and forwardly of the first compartment and also configured for accommodating individuals in substantially horizontal positions;

electric battery means operatively coupled to said power means and situated rearwardly of said first personnel compartment.

2. The mine car as set forth in claim 1, including a substantially planar roof over said first, second, third and the driver compartments respectively.

3. The mine car as set forth in claim 1, including structure defining respective side access openings communicating with said second and third personnel compartments for permitting entry into the second and third compartments.

4. The mine car as set forth in claim 1, said surface-engaging means comprising a pair of forward wheels, and a pair of rearward wheels.

5. The mine car as set forth in claim 4 wherein is provided fore and aft wheel axles and suspension means comprising short coupled leaf spring assemblies mounted on top of each axle and supporting the body on said wheel axles.

6. The mine car as set forth in claim 4, said second and third personnel compartments being respectively located forwardly of said front pair of wheels, said driver compartment being located at least partially between said front wheels.

7. The mine car as set forth in claim 1, said electric power means comprising an electric motor, a differential operably coupled to said motor, and respective drive lines operatively coupled to front and rear wheels, said front and rear wheels comprising said surface-engaging means, there being structure enclosing said differential, and a majority of the length of each of said drive lines.

8. The mine car as set forth in claim 7, including a selectively operable brake assembly operatively coupled to each output of said differential, and located within said enclosing structure.

* * * * *